US008634584B2

(12) United States Patent
Greger et al.

(10) Patent No.: US 8,634,584 B2
(45) Date of Patent: Jan. 21, 2014

(54) EARPHONE

(75) Inventors: Christoph Greger, Delligsen (DE); Hatem Foudhaili, Hannover (DE); Guenter Poeppel, Stadthagen (DE); Grit Bonin, Hannover (DE)

(73) Assignee: Sennheiser electronic GmbH & Co., KG, Wedemark (DE)

( * ) Notice: Subject to any disclaimer, the term of this patent is extended or adjusted under 35 U.S.C. 154(b) by 0 days.

(21) Appl. No.: 13/565,227

(22) Filed: Aug. 2, 2012

(65) Prior Publication Data

US 2013/0034260 A1 Feb. 7, 2013

(30) Foreign Application Priority Data

Aug. 3, 2011 (DE) ..... 10 2011 080 383

(51) Int. Cl.
*H04R 25/00* (2006.01)

(52) U.S. Cl.
USPC ..... 381/380; 381/370

(58) Field of Classification Search
USPC ..... 381/370–382; D14/150–250
See application file for complete search history.

(56) References Cited

U.S. PATENT DOCUMENTS

| | | | | |
|---|---|---|---|---|
| 7,616,772 | B2 * | 11/2009 | Sabick et al. | 381/374 |
| D619,566 | S * | 7/2010 | Yu | D14/223 |
| 2008/0240485 | A1 | 10/2008 | Dyer et al. | |
| 2008/0285782 | A1 | 11/2008 | Gommel et al. | |
| 2009/0034775 | A1 * | 2/2009 | Burton | 381/380 |
| 2009/0103764 | A1 * | 4/2009 | Stiehl et al. | 381/380 |
| 2009/0154749 | A1 * | 6/2009 | Jorgensen et al. | 381/328 |
| 2009/0232342 | A1 * | 9/2009 | Oliveira et al. | 381/382 |

FOREIGN PATENT DOCUMENTS

| | | |
|---|---|---|
| DE | 10 2007 023 054 | 11/2008 |
| DE | 11 2008 000 785 | 3/2010 |
| WO | WO 2005/069683 | 7/2005 |
| WO | WO 2009/086555 | 7/2009 |

* cited by examiner

*Primary Examiner* — Brian Ensey
*Assistant Examiner* — Norman Yu
(74) *Attorney, Agent, or Firm* — Frommer Lawrence & Haug LLP

(57) ABSTRACT

There is provided an earphone having a click unit for clicking on or to a housing of the earphone. The click unit has an ear pad and a fitment. The fitment has a first end and a second end, wherein the ear pad can be fitted on to the second end. The first end of the fitment has at least one spring element.

5 Claims, 7 Drawing Sheets

EARPHONE

The present application claims priority from German Patent Application No. DE 10 2011 080 383.1 filed on Aug. 3, 2011, the disclosure of which is incorporated herein by reference in its entirety.

FIELD OF THE INVENTION

The present invention concerns an earphone, in particular an in-ear earphone and an ear canal earphone.

DESCRIPTION OF RELATED ART

It is noted that citation or identification of any document in this application is not an admission that such document is available as prior art to the present invention.

Earphones such as for example in-ear earphones or ear canal earphones have long been known.

U.S. Pat. No. 7,616,772 B2 discloses a multi-part in-ear earphone. As general state of the art attention is directed to DE 10 2007 023 054 A1, DE 11 2008 000 785 T5, WO 2005/069683 A1 and WO 2009/086555 A1.

It is noted that in this disclosure and particularly in the claims and/or paragraphs, terms such as "comprises", "comprised", "comprising" and the like can have the meaning attributed to it in U.S. patent law; e.g., they can mean "includes", "included", "including", and the like; and that terms such as "consisting essentially of" and "consists essentially of" have the meaning ascribed to them in U.S. patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of, any previously described product, method of making the product, or process of using the product.

SUMMARY OF THE INVENTION

An object of the present invention is to provide an earphone which has improved wearing comfort and improved assembly properties.

Thus there is provided an earphone having a click unit for clicking on or to a housing of the earphone. The click unit has an ear pad and a fitment. The fitment has a first end and a second end, wherein the ear pad can be fitted on to the second end. The first end of the fitment has at least one spring element.

In an aspect of the invention the earphone has a gauze which is adapted to be removable and thus cleanable. The gauze is adapted to maintain the acoustic properties of the earphone.

The invention also concerns an earphone comprising a click unit having an ear pad and a latching unit has a first end and a second end. The ear pad is mounted on the second end of the latching unit. The ear pad has a first end and a second end, the first end having a spring unit which acts on the first end of the fitment.

The invention also concerns a click unit for clicking on a portion of the earphone, wherein the click unit has a peripherally extending sealing lip for sealing the click unit on to the portion of the earphone.

The invention also concerns a resonator assembly which has a resonator unit with a first end and a second end and a gauze, wherein the gauze is fixedly mounted on the second end of the resonator unit. An electroacoustic reproduction transducer is mounted at the first end of the resonator unit.

The invention also concerns an earphone comprising an ear pad having a first end and a second end, wherein the second end is adapted for insertion into an ear of a user. A wave cut is provided at the second end.

In an aspect of the invention the first end of the fitment projects out of an ear canal of a user when the earphone is in the form of an ear canal earphone and is placed in the ear canal.

In a further aspect of the invention the outside diameter of the first end of the fitment is larger than the inside diameter of the ear canal.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
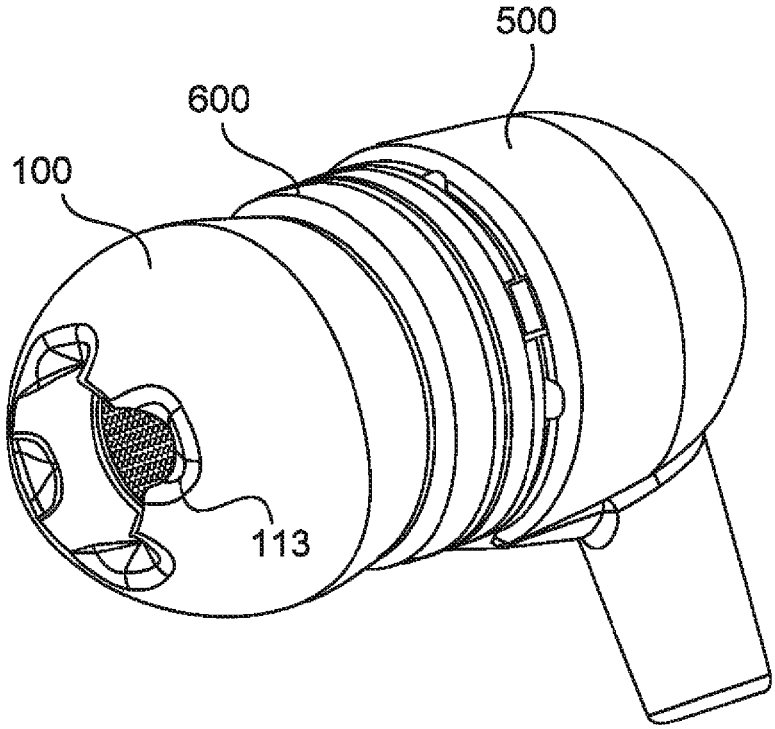
FIG. 1 shows a perspective view of an earphone according to a first embodiment.
Figure 2:
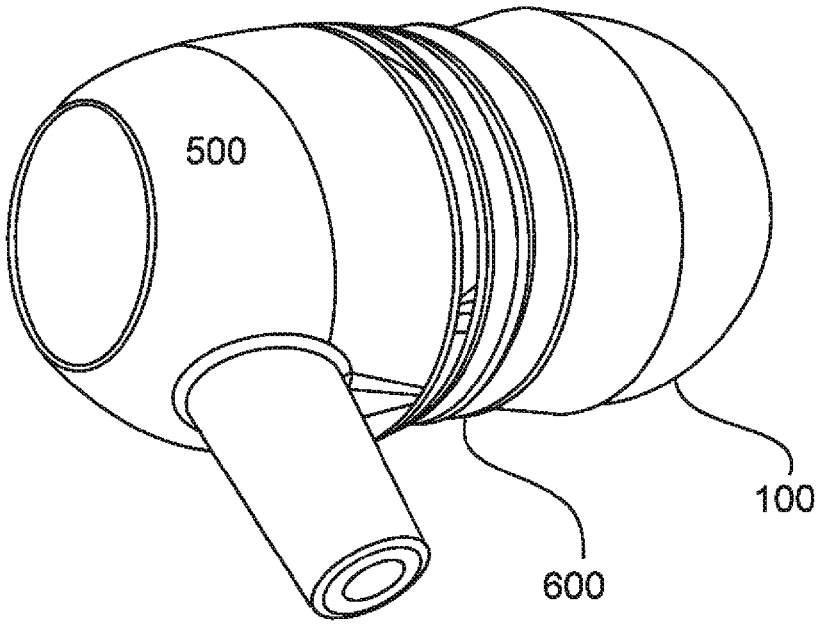
FIG. 2 shows a further perspective view of an earphone according to a first embodiment.

FIGS. 1 and 2 show two perspective views of an earphone according to a first embodiment. The earphone according to the first embodiment is in the form of an in-ear earphone or ear canal earphone. The earphone has an ear pad 100, a ring 600 and a rearward housing or cap 500. The ear pad 100 can optionally have a wave cut 113 at its ear end.

Figure 3:
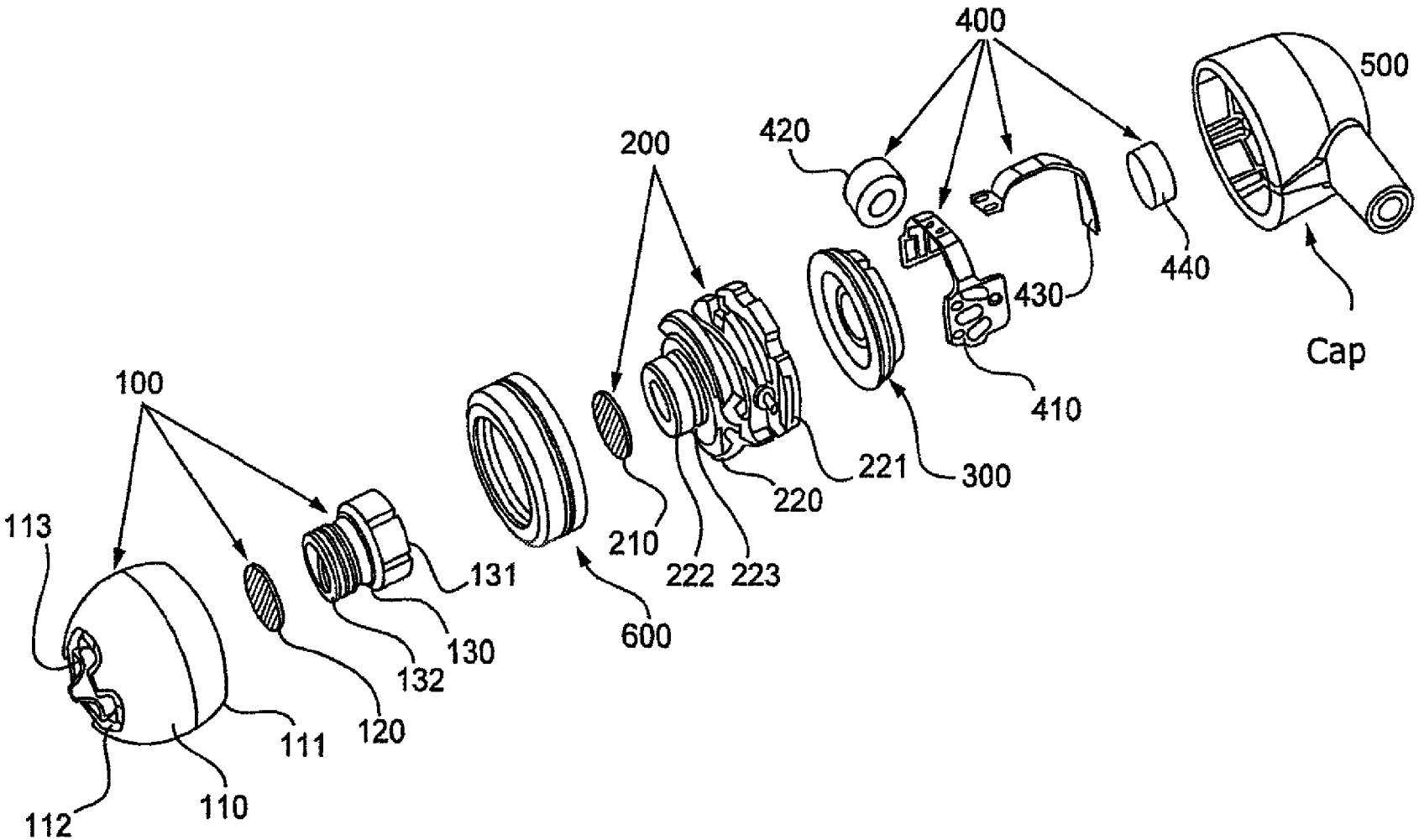
FIG. 3 shows an exploded view of an earphone according to a second embodiment.

FIG. 3 shows an exploded view of an earphone according to the second embodiment. In this case the earphone of the second embodiment can correspond to the earphone of the first embodiment. The earphone has a click unit 100, a decorative ring 600, a resonator assembly 200, an electroacoustic reproduction transducer 300, an electronic assembly 400 and a cap or rearward housing 500. The earphone of the second embodiment can be in the form of an in-ear earphone or an ear canal earphone. In addition the earphone can be assembled in the succession or sequence shown in FIG. 3.

The click unit 100 can be releasably fixed on or in the earphone or its housing and has an ear pad 110, optionally a gauze 120 and a (resonator) fitment 130. The ear pad 110 has a first end 111 and a second end 112. A wave cut 113 can optionally be provided at the second end 112 (the end towards the ear). The (resonator) fitment 130 has a first end 131 and a second end 132. The gauze 120 can serve as protection from dirt and can be placed on the second end 132 of the resonator fitment 130. The resonator fitment 130 with the gauze 120 can then be mounted or fixed to or in the first end 111 of the ear pad 110.

The resonator assembly 200 has a resonator unit 220 and a further gauze 210 (while the gauze 210 is adapted to be replaceable jointly with the assembly 100, the gauze 210 can optionally be fixedly secured to the resonator unit 220).

The electronic assembly 400 can have a first microphone and a second microphone 420, 440 and two flexible circuit boards 410, 430. The microphone 420 is provided at an end of the first flexible circuit board 410 and the second microphone 440 is provided at an end of the second flexible circuit board 430. That serves in particular to facilitate assembly.

Figure 4:
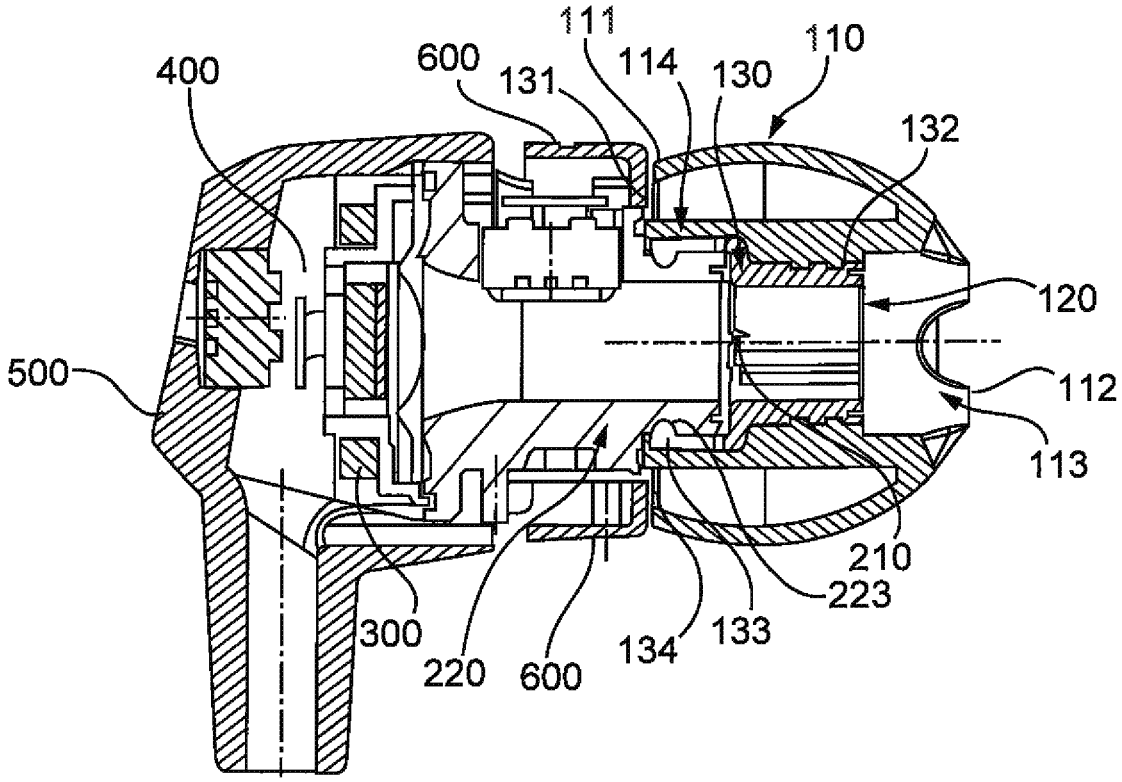
FIG. 4 shows a sectional view of an earphone according to a third embodiment.

FIG. 4 shows a sectional view of an earphone according to the third embodiment. The earphone of the third embodiment can correspond to the earphone of the first or second embodiment. The earphone of the third embodiment thus has a click unit 100, a decorative ring 600, a resonator assembly 200, an electroacoustic reproduction transducer 300, an electronic assembly 400 and a housing cap 500. The click unit 100 has an ear pad 110, a dirt-prevention gauze 120 and a resonator fitment 130. The ear pad 110 has a first end 111 and a second end 112. The second end 112 is introduced into the ear canal of a user. A wave cut 113 is optionally provided at the second end 112 of the ear pad 110. The resonator fitment 130 has a first end 131 and a second end 132 on which the gauze 120 can be replaceably placed. At least one spring element, for example a latching hook 133, can be provided at the first end 131 of the resonator fitment 130. In addition at its first end 111 the ear pad 110 can optionally have a (at least partially peripherally extending) spring element 114 serving for radial tolerance compensation. In that case the spring element 114 can press against the latching hooks 133 so that it is possible to provide for an improved fit for the click unit on the resonator unit 200. At its second end 122 the resonator unit 220 can have an at least partially peripherally extending groove 320 into which the latching hooks 133 can latch.

A decorative ring or a protective ring including a seal 600 can be placed in the region of the second end 222 of the resonator unit 220, for example to be able to protect or seal off outwardly the resonator fitment 130 and/or the second end 222 of the resonator unit 220. The transducer 300 is provided at the first end 221 of the resonator unit. The gauze 210 at the second end 222 of the resonator unit 220 is fixedly mounted and serves to protect the electroacoustic reproduction transducer 300 which is fixed at the first end 221 of the resonator unit 220. The gauze can optionally be used as acoustic damping.

Figure 5:
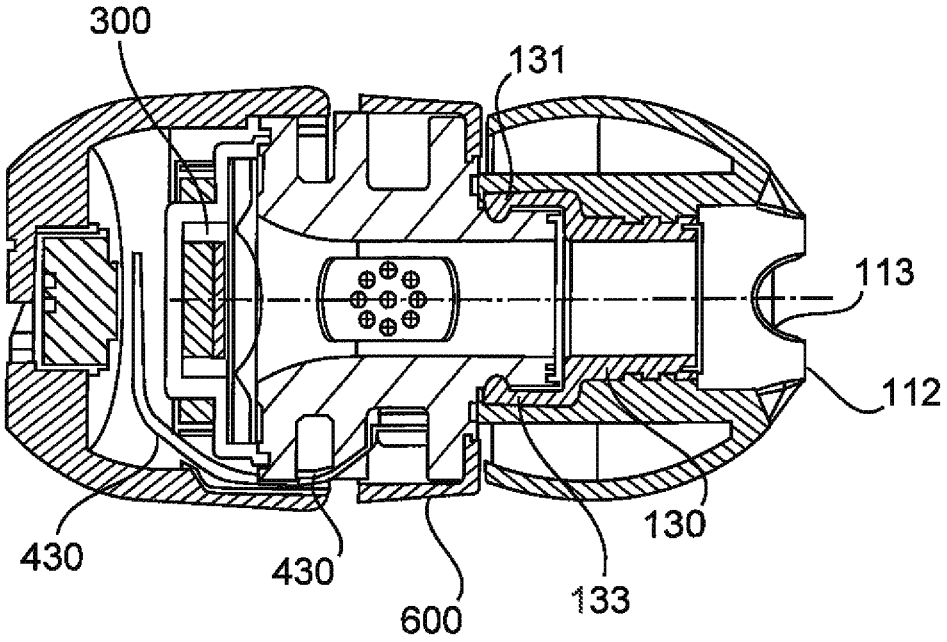
FIG. 5 shows a further sectional view of the earphone according to the third embodiment

FIG. 5 shows a further sectional view of the earphone according to the third embodiment. FIG. 5 also shows the flexible circuit boards 410, 430.

According to the invention the earphone has a click unit comprising an ear pad 110, an optionally removable gauze 120 and a resonator fitment 130. The click unit 100 can preferably be fitted or clicked on to a portion of the earphone. The provision of the click unit (with the ear pad and the fitment) provides a simple option for fitting the ear pad to the earphone. According to the invention dirt present can be easily removed. Thus there can be provided an easy cleaning option insofar as dismantling for cleaning purposes can be easily effected.

Optionally at its first end 111 the ear pad 110 of the click unit 100 can have a sealing lip 134. Tolerances in the axial direction can be compensated by the provision of the sealing lip.

In a further aspect of the invention there is provided an earphone having a click unit 100 which has a peripherally extending spring element 114 which exerts a spring action on the first end 111 of the resonator fitment 130.

In an aspect of the invention the earphone has a click unit 100 with a replaceable gauze 120. Optionally the earphone can have a resonator unit 200 having a second gauze 210 fixedly secured to the resonator unit 220. Because the first gauze 120 is adapted to be replaceable and is in front of the second gauze 210 in the direction of the eat the second gauze 210 is substantially protected from dirtying. Because the second gauze 210 is fixedly secured to the resonator unit 220 and the transducer 300 is also fixedly secured to the resonator 220 the second gauze 210 serves to protect the electroacoustic transducer 300.

In an aspect of the invention there is provided an earphone having an ear pad. The ear pad has a first end 111 and a second end 112, the second end 112 being in the direction of the ear. A wave cut 113 can optionally be provided at the second end 212. The provision of the wave cut 113 at the second end 112 is advantageous in particular when inserting the ear canal earphone into an ear canal because that avoids complete closure of the ear by the ear canal earphone upon insertion or introduction (insert leading). It is only when the ear canal earphone has been introduced into the ear canal that complete closure occurs. In addition, that avoids unwanted deflection of the diaphragm of the electroacoustic transducer 300 upon insertion into the ear canal. Furthermore the wave cut 113 at the second end 112 of the ear pad 110 is advantageous because in that way no abrupt unpleasant changes in pressure are applied to the eardrum.

The wave cut 113 at the second end 112 of the ear pad 110 is also advantageous if the earphone has an active noise reduction unit. The waviness of the ear pad makes it possible to avoid complete closure of the front volume of the ear canal earphone during the process of inserting the ear canal earphone into the ear canal. Complete closure is achieved only after the insertion operation, that is to say when the ear canal earphone has been placed in the ear canal. That makes it possible to avoid an unwanted feedback if the earphone has an active noise reduction unit.

In a further aspect of the invention the earphone has an electronic assembly 400 which comprises for example two flexible circuit boards. The fact that the flexible circuit boards are divided into two makes it possible for two parts of the earphone to be separately pre-assembled. That is advantageous because it permits parallel operation, with a time saving. Contacting of the components of the earphone can be implemented for example when fitting the housing portions together so that no additional soldering operation is needed.

Figure 6:
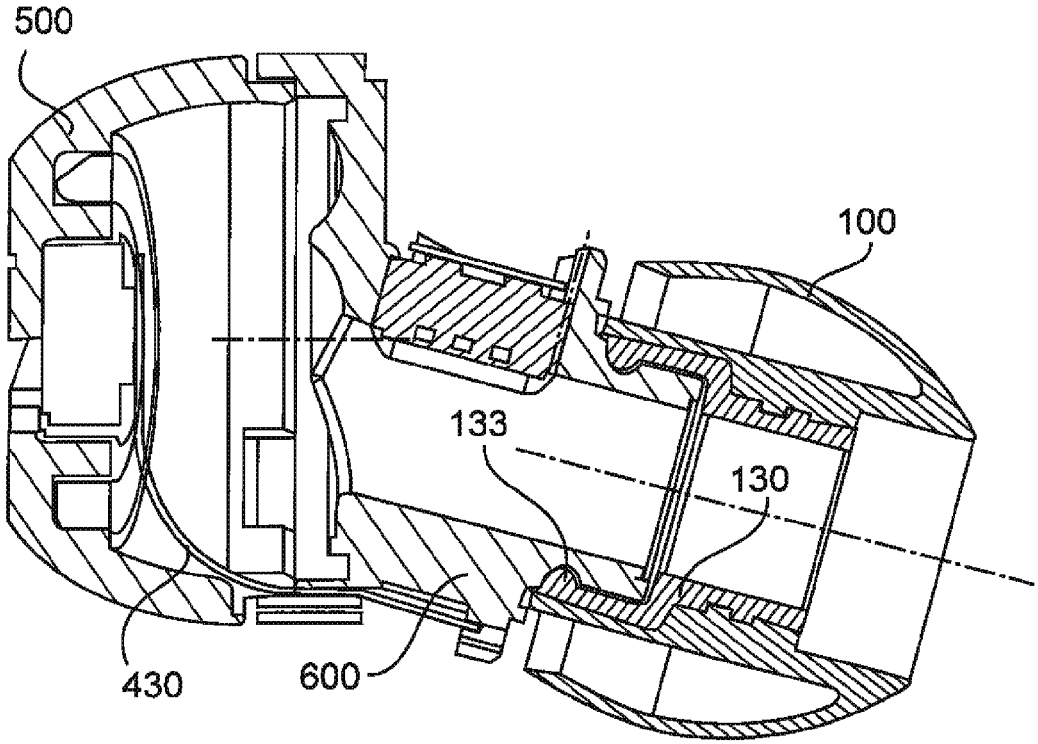
FIG. 6 shows a sectional view of an earphone according to a fourth embodiment

FIG. 6 shows a sectional view through an earphone according to the fourth embodiment. The earphone of the fourth embodiment can be based on an earphone according to the first, second or third embodiment. The earphone has a click unit 100, a decorative ring 600, a resonator assembly 200, an electroacoustic reproduction transducer 300, an electronic assembly 400 and a housing cap 500. The click unit has an ear pad 110, a gauze 120 and a resonator fitment 130.

Figure 7:
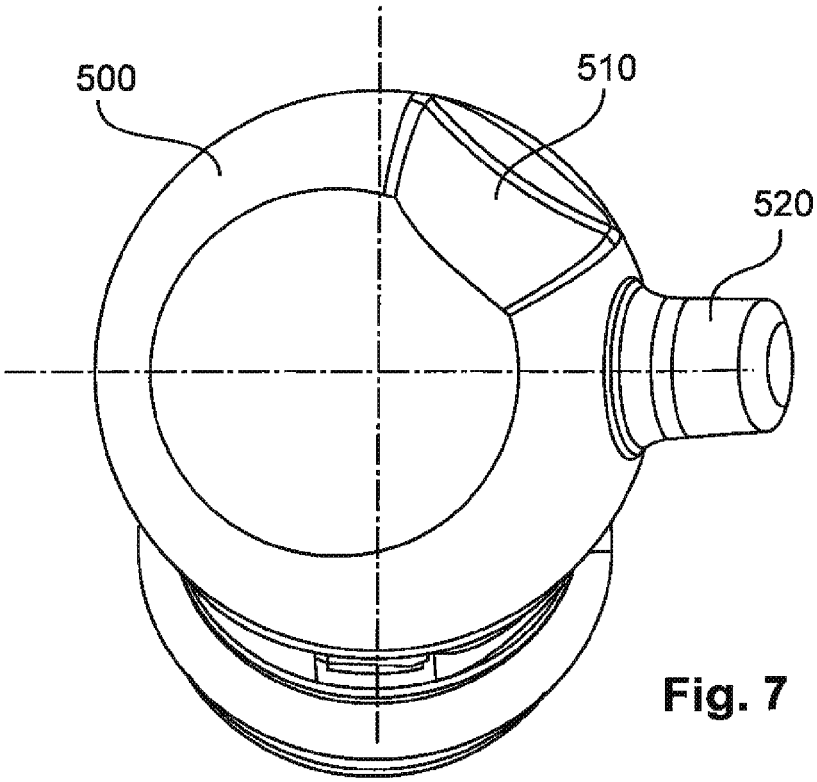
FIG. 7 shows a perspective view of an earphone according to the fourth embodiment

FIG. 7 shows a perspective view of an earphone according to the fourth embodiment. The earphone of the fourth embodiment can be based on an earphone according to the first, second or third embodiment. The earphone has an outer cap 500 with a bulge portion 510 and a sound guide portion 520. The bulge portion 510 serves to be placed against the anti-tragus of the outer ear.

Figure 8A:
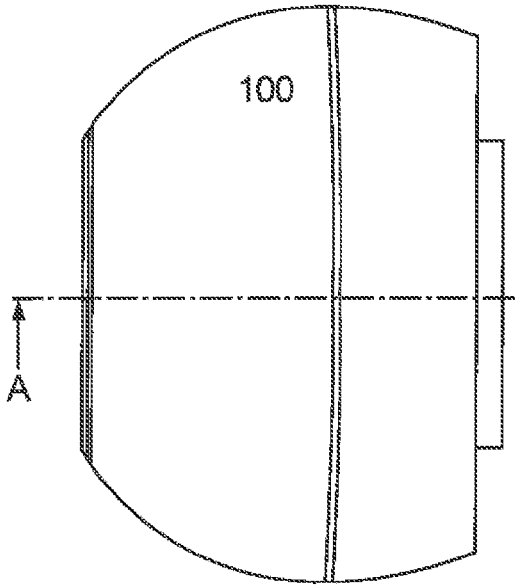
FIGS. 8A through 8C show various views of a portion of an earphone according to a fifth embodiment.
Figure 8C:
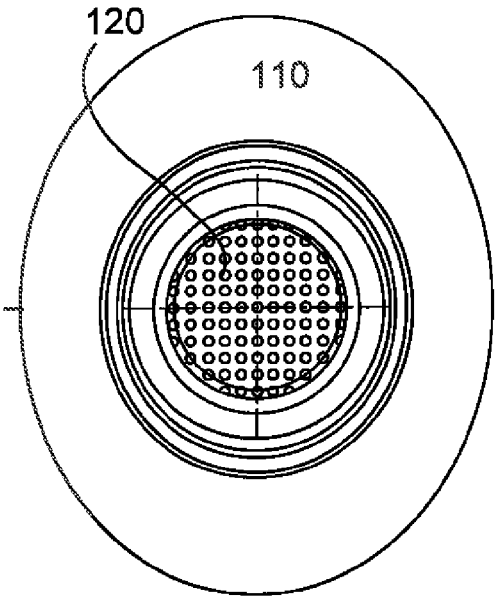
Figure 8B:
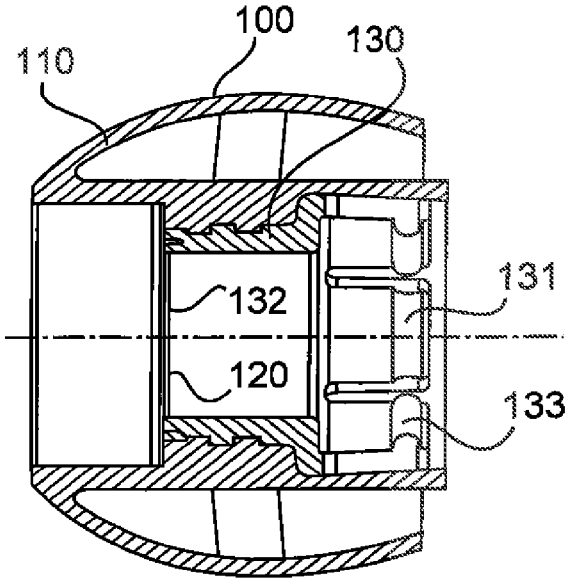

FIGS. 8A through 8C show various views of an earphone according to a fifth embodiment. FIG. 8A shows a side view of the click unit 100 with an ear pad 110.

FIG. 8B shows a section along line A-A in FIG. 8A. The click unit 100 has an ear pad 120 and a resonator fitment 130. The resonator fitment 130 has a first end 131 with a spring element or latching hook 133 and the second end 132 of the resonator fitment serves to accommodate a gauze 120.

FIG. 8C shows a plan view of the click unit in FIG. 8A.

Figure 9A:
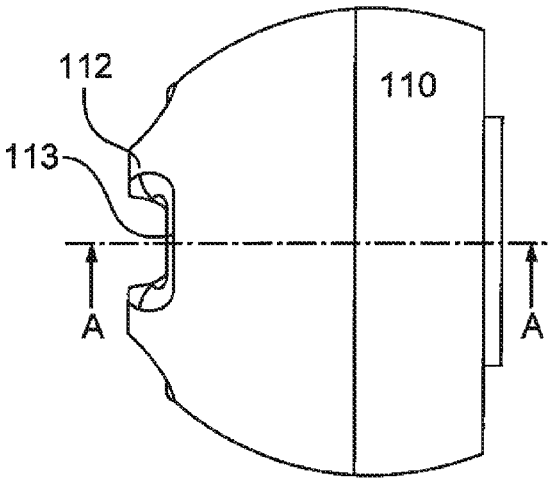
FIGS. 9A through 9C show various views of a portion of an earphone according to a sixth embodiment.
Figure 9C:
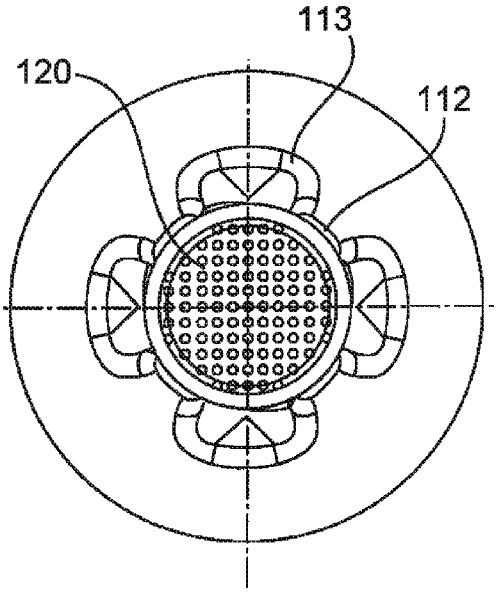
Figure 9B:
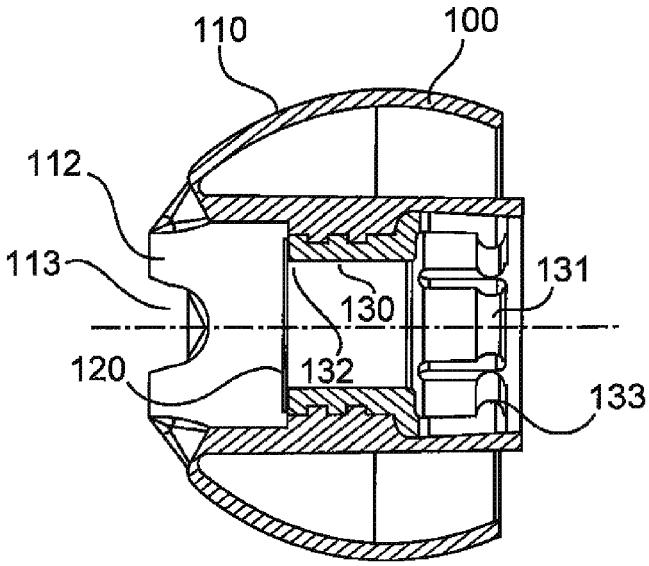

FIGS. 9A through 9C show various views of a portion of an earphone according to a sixth embodiment. FIG. 9A shows a plan view of a click unit of an earphone according to the fifth embodiment. The click unit has an ear pad 110 with a first end 111. Optionally a wave cut 113 is provided here. That end of the earphone serves to be inserted into an ear canal of a listener.

FIG. 9B shows a sectional view along section line A-A in FIG. 9A. This Figure shows in particular a click unit 100 with an ear pad 110, a gauze 120 and a resonator fitment 130. The resonator fitment 130 has a first end 131 with spring elements or latching hooks 133 and a second end 132 which is adapted to accommodate a gauze.

FIG. 9C shows a plan view of a click unit of an earphone according to the sixth embodiment.

Figure 10A:
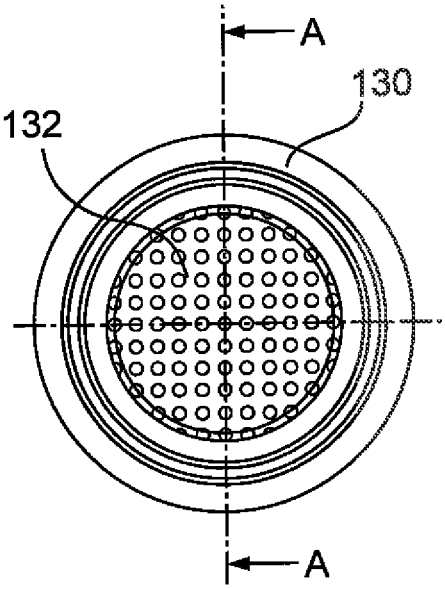
FIGS. 10A through 10B show various views of a click unit of an earphone according to a seventh embodiment.
Figure 10B:
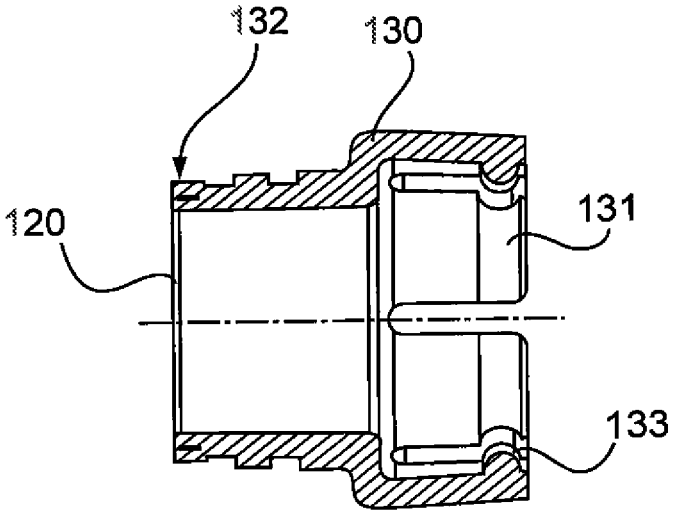

FIG. 10A shows a plan view of a resonator fitment of a sixth embodiment. FIG. 10B shows a sectional view along section line A-A in FIG. 10A. The resonator fitment 130 has a first end 131 with spring elements or latching hooks 133 and a second end 132 which serves to accommodate a gauze 120.

The earphones of the fifth through seventh embodiments can be based on the earphones of the first through fourth embodiments or can be combined with them.

In a further aspect of the present invention which can be based on one of the preceding embodiments the inside diameter of the click unit, through which the sound passes, is to be as large as possible. As however the outside diameter of the click unit cannot become larger because of the geometrical factors of a typical ear canal it is necessary to find a way of making the wall of the click unit thinner. For that purpose the click unit 100 and in particular the end 131 of the resonator 130 are of such a configuration that the end 131 of the resonator 130 projects out of the ear canal (when the earphone is placed in the ear canal) and can thus be of a larger outside diameter. The end 131 can then be placed on the resonator 200 so that the click unit 100 is fixed to the resonator 200.

According to the invention the fixing unit for fixing the click unit to the rest of the earphone is brought out of the region which is placed in the ear canal or is provided outside that region. That means that the acoustically effective inside diameter of the click unit can be enlarged. Optionally the ear pad 110 can be fixedly glued to the resonator fitment 130. In that way the user can replace the entire click unit (ear pad 110, gauze 120 and resonator fitment 130).

Thus there is provided an earphone which has a resonator 200 and a click unit 100, wherein the click unit can be fixed with an end 130 to the resonator 200. In that case the end 131 is not disposed in the ear canal of the user when the ear canal earphone is placed in the ear canal.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An ear canal earphone comprising:

resonator unit with a first end and a second end;

an electroacoustic reproduction transducer which is mounted at the first end of the resonator unit; and a click unit configured to click on or to the resonator unit;

wherein the second end of the resonator unit has an at least partially peripherally extending groove;

wherein the click unit has an ear pad and a fitment;

wherein the fitment has a first end and a second end;

wherein the first end of the fitment is configured to project out of an ear canal of a user when the earphone is placed in the ear canal;

wherein the ear pad is fitted onto the second end of the fitment;

wherein the first end of the fitment has latching hooks configured to latch into the groove at the second end of the resonator unit;

wherein the ear pad extends from the second end of the fitment to the first end of the fitment, forming an at least partially peripherally extending spring element for improving the fit of the click unit on the resonator unit by against the latching hooks;

wherein, the ear pad further extends over the first end of the fitment to form a peripherally extending sealing lip configured to seal the click unit onto the second end of the resonator unit; and wherein the ear pad is fixedly mounted to the fitment.

2. The earphone as set forth in claim 1, further comprising:

a gauze which is configured to be removable and thus cleanable;

wherein the gauze is adapted to maintain the acoustic properties of the earphone; and wherein the second end of the fitment serves to accommodate the gauze.

3. The earphone as set fort in claim 1, further comprising:

a gauze;

wherein the gauze is fixedly mounted on the second end of the resonator unit.

4. The earphone as set forth in claim 1:

wherein the eat pad has a first end and a second end;

wherein the second end of the ear pad is configured for insertion into an car of a user; and wherein a wave cut is provided at the second end of the eat pad.

5. The earphone as set forth in claim 1:

wherein an outside diameter of the first end of the fitment is larger than an inside diameter of an ear canal of a user.

* * * * *

UNITED STATES PATENT AND TRADEMARK OFFICE

CERTIFICATE OF CORRECTION

PATENT NO. : 8,634,584 B2
APPLICATION NO. : 13/565227
DATED : January 21, 2014
INVENTOR(S) : Christoph Gregor et al.

It is certified that error appears in the above-identified patent and that said Letters Patent is hereby corrected as shown below:

Specification

In Column 4, line 21 “eat” should read -- ear --

Claims

In Claim 1, Column 6, line 16 “resonator unit” should read -- a resonator unit --

In Claim 1, Column 6, line 35 “resonator unit by against” should read -- resonator unit by pressing against --

In Claim 1, Column 6, line 37 “Wherein,” should read -- Wherein --

In Claim 3, Column 6, line 49 “The earphone as set fort” should read -- The earphone as set forth --

In Claim 4, Column 6, line 54 “Wherein the eat pad” should read -- Wherein the ear pad --

In Claim 4, Column 6, line 56 “insertion into an car” should read -- insertion into an ear --

In Claim 4, Column 6, line 57 “Wherein a wave cut is provided at the second end of the eat pad” should read -- Wherein a wave cut is provided at the second end of the ear pad --

Signed and Sealed this
Sixteenth Day of February, 2016

Michelle K. Lee

Michelle K. Lee
*Director of the United States Patent and Trademark Office*